US010905226B2

(12) United States Patent
Cole et al.

(10) Patent No.: US 10,905,226 B2
(45) Date of Patent: Feb. 2, 2021

(54) LIGHT WEIGHT MODULAR POUCH ATTACHMENT SYSTEM AND METHOD

(71) Applicant: FirstSpear, LLC, Fenton, MO (US)

(72) Inventors: Michael E. Cole, Ste. Genevieve, MO (US); Scott J. Carver, Chesterfield, MO (US)

(73) Assignee: FirstSpear Technology Group, LLC, Fenton, MO (US)

( * ) Notice: Subject to any disclaimer, the term of this patent is extended or adjusted under 35 U.S.C. 154(b) by 72 days.

(21) Appl. No.: 15/985,215

(22) Filed: May 21, 2018

(65) Prior Publication Data

US 2018/0271264 A1 Sep. 27, 2018

Related U.S. Application Data

(62) Division of application No. 15/431,377, filed on Feb. 13, 2017, now Pat. No. 9,974,379, which is a division of application No. 14/237,468, filed as application No. PCT/US2012/050001 on Aug. 8, 2012, now Pat. No. 9,565,922.

(51) Int. Cl.

| | |
|---|---|
| ***A45F 5/02*** | (2006.01) |
| ***A45F 3/00*** | (2006.01) |
| ***A44B 18/00*** | (2006.01) |
| ***F42B 39/02*** | (2006.01) |

(Continued)

(52) U.S. Cl.

CPC ..... *A45F 5/02* (2013.01); *A44B 18/00* (2013.01); *A44B 18/0073* (2013.01); *A45F 3/00* (2013.01); *A45F 3/14* (2013.01); *A45F 5/021* (2013.01); *F42B 39/02* (2013.01); *A45C 13/30* (2013.01); *A45C 2013/306* (2013.01);

(Continued)

(58) Field of Classification Search

CPC ..... A45F 5/02; A45F 3/00; A45F 3/14; A45F 5/021; A45F 2003/001; A45F 2003/146; A45C 13/30; A45C 2013/306; A44B 18/00; A44B 18/0073; F42B 39/02; Y10T 24/13; Y10T 24/1382

See application file for complete search history.

(56) References Cited

U.S. PATENT DOCUMENTS 7,993,715 B2 † 8/2011 Geva
9,173,436 B2 † 11/2015 Crye (Continued)

FOREIGN PATENT DOCUMENTS

GB 2351651 A † 10/2001

*Primary Examiner* — Corey N Skurdal
(74) *Attorney, Agent, or Firm* — Matthews Edwards LLC

(57) ABSTRACT

An attachment system for supporting holders on a carrier includes a platform having a front side, an opposite back side, the platform being constructed of laminated layers having slits therethrough defined and bound by opposite edges of the layers fused together to increase wear and abrasion resistance of the edges, the slits arranged in a predetermined pattern of aligned and spaced apart rows, the slits being configured to receive straps therethrough between the front side and the back side to attach at least one holder to the platform, and the platform being supported by and comprising an element of a carrier configured to be worn against a portion of a user's body, the back side and at least one element of the carrier or a backing element defining and bounding a generally flat cavity through which the back side can be accessed.

23 Claims, 16 Drawing Sheets

(51) Int. Cl.
*A45F 3/14* (2006.01)
*A45C 13/30* (2006.01)

(52) U.S. Cl.
CPC ... *A45F 2003/001* (2013.01); *A45F 2003/146* (2013.01); *Y10T 24/13* (2015.01); *Y10T 24/1382* (2015.01)

(56) References Cited

U.S. PATENT DOCUMENTS

2008/0235841 A1† 10/2008 McDunn
2013/0312149 A1† 11/2013 Asher

† cited by third party

LIGHT WEIGHT MODULAR POUCH ATTACHMENT SYSTEM AND METHOD

This application is a division of co-pending division U.S. patent application Ser. No. 15/431,377, filed Feb. 13, 2017, which application is a division of U.S. patent application Ser. No. 14/237,468, filed Feb. 6, 2014, which issued on Feb. 14, 2017 as U.S. Pat. No. 9,565,922, which was submitted under 35 U.S.C. 371 claiming priority to PCT/US2012/50001, filed Aug. 8, 2012, claiming the benefit of U.S. Provisional Application No. 61/521,309, filed Aug. 8, 2011.

TECHNICAL FIELD

The present invention relates generally to a system and method for removably attaching pouches and other accessories to a carrier, such as a vest or other garment, or other device, and more particularly, which is light weight, non-metallic, resists accumulation of, and degradation of operation from, particulates such as dirt dust and the like, is quiet in operation, and is compatible with some known systems.

BACKGROUND ART

The disclosures of co-pending division U.S. patent application Ser. No. 15/431,377, filed Feb. 13, 2017, division patent application Ser. No. 14/237,468, filed Feb. 6, 2014, now U.S. Pat. No. 9,565,922, issued Feb. 14, 2017, PCT application Serial No. PCT/US2012/50001, filed Aug. 8, 2012, and U.S. Provisional Application No. 61/521,309, filed Aug. 8, 2011, are hereby incorporated herein in its entirety by reference.

Modular pouch attachment systems and methods for carrier garments, hereinafter sometimes referred to by the term carrier or carriers, such as, but not limited to, vests, cummerbunds, belts, and the like, for carrying holders such as, but not limited to, pouches for holding items and accessories on a person's body, are well known. Advantages include an ability to attach pouches and accessories to a platform and easily remove them; rearrange or configure them; and exchange for other pouches or accessories.

Reference, Kirk et al., U.S. Pat. No. 5,724,707, issued on Mar. 10, 1998; and Johnson, U.S. Pat. No. 7,047,570, issued on May 23, 2006, which show representative commercially available pouch attachment systems and methods. Typically, as shown in FIGS. 3A and 3B of the U.S. Pat. No. 7,047,570 patent, reproduced here as FIGS. 1 and 2, such known systems utilize one or more elongate woven webs or straps, sewn or otherwise affixed to at longitudinally spaced locations to a panel comprising fabric layers, forming a side by side pattern of loops. If multiple webs or straps are used, they are laterally spaced apart, e.g., vertically, so as to extend horizontally across a surface of the garment or other device, at vertically spaced intervals, such that the loops of the webs will be vertically aligned. A pouch or other accessory will include one or more elongate straps configured to be inserted through the aligned loops. The straps will typically each be attached at one end to the pouch or accessory, and have an opposite free end. The backside of the pouch or other accessory will typically include additional loops positioned to be disposed in alternating relation to the loops on the panel, such that the straps can be alternatingly woven through the loops on the panel and the back of the pouch or accessory, for attaching the pouch or accessory to the panel. The free end of the attachment straps can then be secured, using a snap, hook and loop fastener, or the like, to the back of the pouch or accessory.

Stated advantages in U.S. Pat. No. 5,724,707 of the known pouch attachment systems such as just discussed, include that they are light weight, quiet to use, and stronger than earlier known systems, including known systems using hook and loop type fasteners. Shortcomings of hook and loop fasteners mentioned in U.S. Pat. No. 5,724,707 include heavy weight, noisiness, low strength, and failure under dirty and dusty conditions. Although past known carriers utilizing hook and loop fasteners have suffered from these disadvantages, inherent advantages of hook and loop fasteners such as ease and familiarity of use, and non-metallic construction, still make them attractive. The non-metallic attribute is particularly desirable for military applications wherein the carrier is subject to explosions which can cause metallic objects to fragment and possibly injure wearers. As a result, it is still sought to find a manner of use hook and loop type fasteners for attachment of holders and the like, particularly for military carrier applications.

Therefore, what is sought is an attachment system and method that utilizes the advantageous attributes of hook and loop fastening systems, but which overcomes one or more of the know disadvantages thereof, set forth above.

SUMMARY OF THE INVENTION

What is disclosed is an attachment system and method for carrier garments such as, but not limited to, vests, cummerbunds, belts, shirts, jackets, pants, and the like, that utilizes the advantageous attributes of hook and loop fastening systems, but which overcomes one or more of the known disadvantages thereof set forth above.

According to a preferred aspect of the invention, the attachment system utilizes a platform having a front side, an opposite back side, and a plurality of slits through the platform arranged in a predetermined pattern of vertically aligned and spaced apart rows, configured for receiving elements for attaching at least one holder to the platform. As a non-limiting example, adjacent ones of the slits can be spaced vertically apart to correspond to the vertical spacing of loops of currently used MOLLE systems. The platform is supported by and comprises an element of, an attachment or accessory to, a carrier configured to be worn on a user's body, for carrying at least one holder at a desired location on the user's body, e.g., front, back, or side. The platform can be permanently affixed, e.g., by stitching, or incorporated into the carrier, or removably attached, e.g., via hook and loop fasteners, belts, snaps, zippers, or the like, in covering relation to an outwardly facing surface of the carrier or a backing element such as, but not limited to, a fabric layer or sheet.

According to another aspect of the invention, a back side of the platform faces and covers the outer surface of the carrier or backing element and includes a first fastening component of a hook and loop fastening system thereon adjacent to, e.g., around or beside, the slits, and disposed in opposing relation to the carrier or backing element surface. This forms a generally flat pocket or cavity between the opposing surface and the back side, into which a user can insert his or her fingers for attaching and detaching objects to/from the fastening component, and/or weaving straps through the slits. This is advantageous as the carrier surface or backing element protects the component of the hook and loop fastener, and with the fastener component located on the back side and in the pocket or cavity, noise generated when detaching from the fastener is contained and muted or muffled so as to be suitable for applications where silence when configuring the system, e.g., adding, removing, moving holders, is required. Also preferably, the platform and the carrier or backing element have generally coextensive peripheral edge portions bounding and at least substantially or effectively enclosing the flat pocket or cavity behind the platform, providing a cover or barrier to entry of particulates such as dirt and dust into the cavity. Operationally, at least one of the coextensive edge portions is open or openable, e.g., via a hook and loop fastening system, buttons, overlapping flaps, etc., to allow the insertion of at least fingers of a hand into the cavity for attaching, detaching, weaving, etc.. In this latter regard, the platform can have any required extent, e.g., the height and width of a person's midsection or chest, and the opening or openings should be sufficiently large and/or positioned to enable a person to reach a desired location within the cavity for attaching and detaching straps or tabs extending through any of the slits.

Each of the slits through the platform is defined and bound by opposing edges, respectively, disposed sufficiently close together when in a free state, to provide an effective barrier to prevent or substantially reduce passage of particulates such as dust and dirt to the fastening system component on the back side of the platform. As a result of this and the enclosing of the pocket or cavity behind the platform, degradation of operation of the fastening system component from accumulated particulate contaminants, e.g., dirt and dust, is sufficiently limited to allow usage of the carrier for intended uses and durations of use, such as military missions.

According to another preferred aspect of the invention, the first fastening component located on the back side of the platform comprises a loop pile fabric layer, which can be of commercially available composition and construction such as available under the trademark "Velcro". The front side can comprise a woven fabric such as a nylon or the like, which is preferably non-stretch, and the fabric layers are joined together by lamination using adhesives, gluing, or fusion. As another preferred aspect, the fabric layers comprising the edges bounding the slits are fused together, e.g., using a laser cutting process for forming the slits, so as to be hardened but at least semi-flexible to allow insertion of flat straps and tabs through the slits, and such that the edges will not fray or wear significantly under expected use. Also preferably, the edges will have sufficient resilient flexibility so as to be capable of conforming at least generally about anticipated items to extend through the slits such as straps or flat tabs that may be attached to the fastening system component within the pocket.

According to another preferred aspect of the invention, the system includes at least one holder including at least one tab having a second component of the hook and loop fastening system thereon, e.g., hooks for use with the pile loop fabric, such as commercially available under the trade name "Velcro". The tabs are substantially flat, so as to be easily insertable through the slits, and a user can position and attach the tabs to the back side of the platform using fingers inserted into the pocket or cavity behind the platform. Similarly, the user can insert the fingers into the pocket to detach the tabs to allow removal or repositioning of the holder.

The tabs attached to the holders can be straight and sized for passage through the slits, or can be V shape, in which case they can be folded or bent as required to pass through the slits and attach to the back side. In this regard, as another advantage of one embodiment of the tabs, they are relatively short, for instance, but not limited to, not exceeding the vertical distance between two adjacent slits of the pattern, even for holders that have a length equal to the distance between 4, 6, or more slits. The tabs can be constructed of a thin nylon film, and with the short length, this provides substantially reduced weight compared to the much longer conventional heavy nylon fabric MOLLE straps. For strength, when inserted through the slits, the tabs are bent over for attachment to the back side, so that the hook and loop fasteners are loaded in shear, and are not subject to direct pulling away from the back side of the platform. The V shape tabs are advantageous in this regard as they provide up to double the attachment capability in a still relatively short, lightweight tab.

As another advantage, the tabs of the present system can be merely inserted through the slits and attached to the back side of the platform, whereas a MOLLE strap would be woven through interlocking loops on both the platform and back of the holder. For longer holders, the short tabs can be provided at spaced locations along the length of the holder, and are insertable and attachable through correspondingly located slits of the platform. The slits are also configured and sized to accommodate multiple tabs, so that a holder can be attached to the platform both above and below a particular slit. This results in an attachment capability that requires less time and is easier to do in the dark and when relying on feel or gloves are used, compared to conventional MOLLE systems. Also, because loops on the back of holders are eliminated, additional weight advantage is achieved.

As an alternative, the tabs can be provided in a length comparable to that of a conventional MOLLE strap, and the back side of a holder can include slits also, to allow weaving and interlocking the holder to the platform using the longer tabs, which will have the second component of the hook and loop fastening system only at an appropriate location on the ends of the tabs. Alternatively, an enlarged tuck tab can be provided on the end of the longer tab, and the tuck tab inserted into an adjacent slit on either the platform or the holder, to secure the holder. In this embodiment, another advantage achieved is that this attachment system can be backwards compatible with existing MOLLE platforms, enabling using the holders with both the platform of the invention and MOLLE platforms.

As another preferred aspect of the invention, the edges bounding the slits of the platform are sufficiently resiliently flexible to allow passage of the tabs therethrough, respectively, for fastening to the loop pile fabric while biasing against the tabs forming at least a partial barrier to passage of particulates thereabout, to further prevent degradation of the hook and loop fastening system. In this regard, the lack of stretch and manner of attachment of the platform allows it to support a relatively large number of holders without pulling away from the supporting carrier, while being sufficiently flexible to accommodate normal body movements such as twisting and bending of the wearer.

As another advantage of the attachment system of the invention, the tightness of attachment of a holder to the platform is a function of the location of attachment of the tabs to the back side. The tabs can be attached to the back side of the platform tightly with little slack, in a manner so as to limit or prevent relative movements of the holder relative to the platform, which may be desirable for some applications wherein low noise is desired or required, or, if desired, with slack to loosely hold the holder to the front side.

As another preferred aspect of the invention, representative holders contemplated for use with the invention include pouches for carrying batteries for electronic equipment, magazines for ammunition and weapons, radio, medical, clothing, food, and the like and the pouch portion of the holder can be of conventional fabric construction. Because weaving of straps through loops on the platform is not necessary, loops on the back of the holder can be eliminated, resulting in significant weight saving without loss of carrying capability or other performance. If desired, the back side of the holders can include a mating pattern of slits to allow interweaving of the tabs between the platform and holder, or the use of separate MOLLE style straps for attachment, if desired.

As a hybrid embodiment of the system of the invention for use with conventional MOLLE straps, the slits are provided on a backing element which includes the second component of the hook and loop fastening system. The backing element is attached to the back side of the platform using the hook and loop fastening system, and the MOLLE straps are inserted through the slits and either pass over the front side of the platform or the back of the backing element, for securing the attached holder to the platform. This embodiment is particularly useful for vertically narrower applications such as belts, and allows carrying longer MOLLE holders such as magazine pouches, on a narrow belt, without relative shifting and movement.

DETAILED DESCRIPTION OF THE INVENTION

Figure 1:
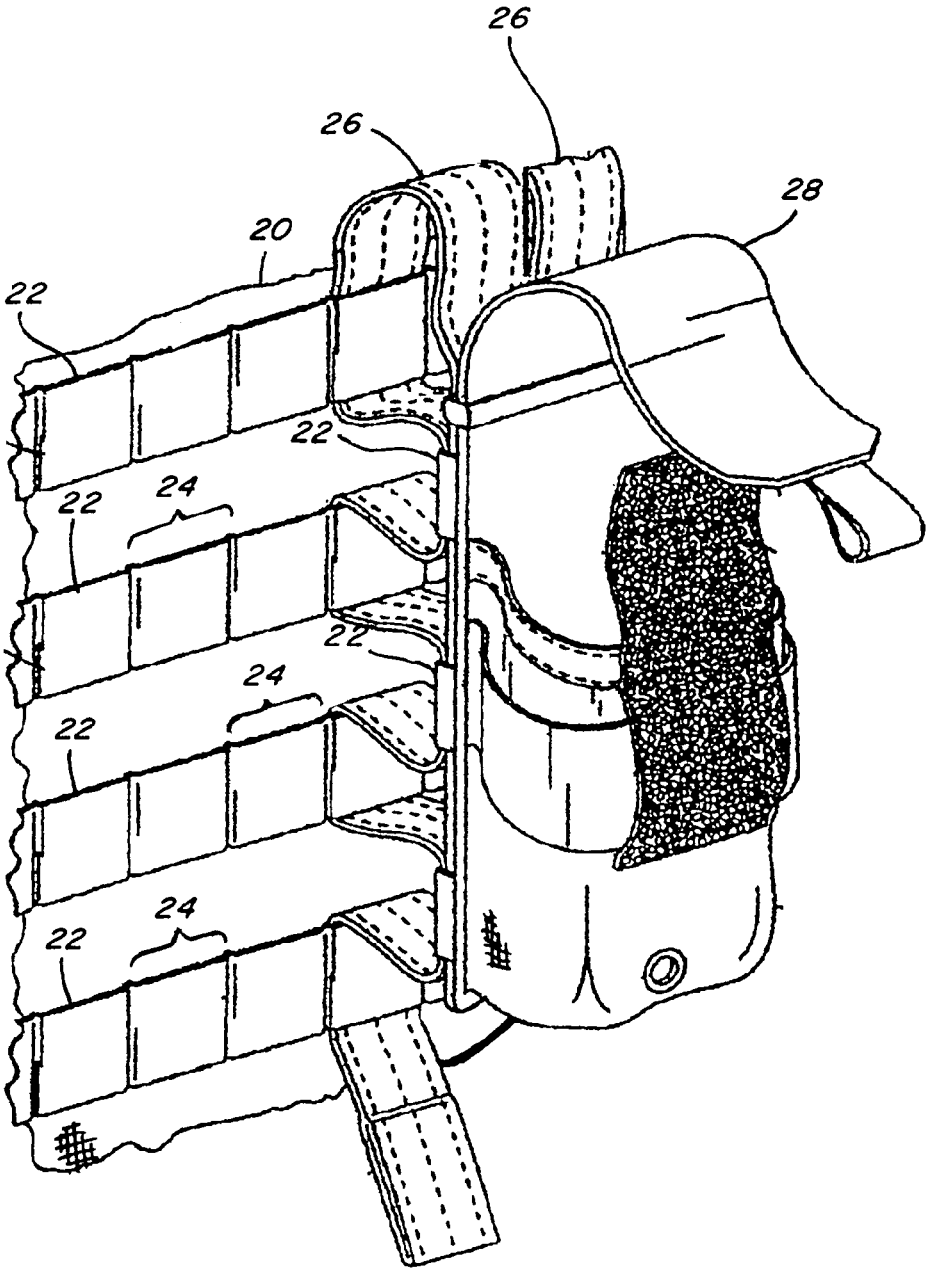
PRIOR ART Fig. 1
FIG. 1 is a fragmentary perspective view of a prior art attachment system, showing a MOLLE style pouch.
Figure 2:
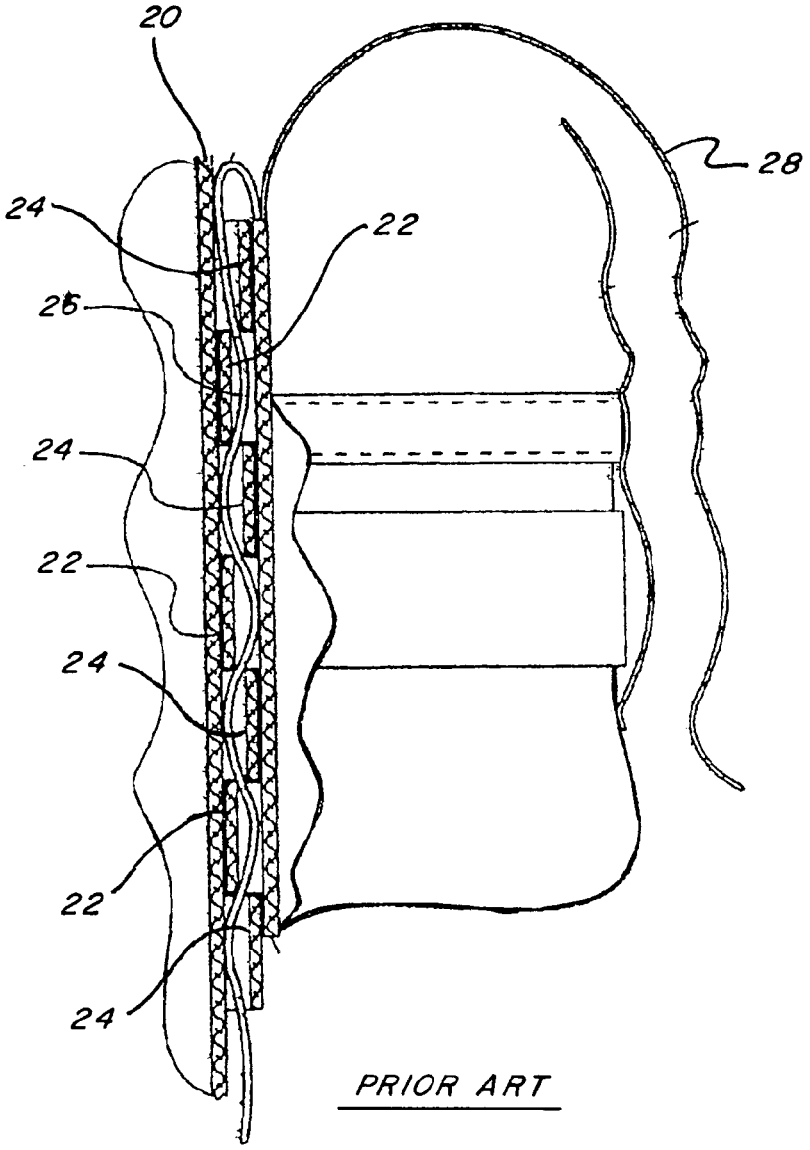
FIG. 2 is a fragmentary sectional view of the attachment system and pouch of FIG. 1.
Figure 4:
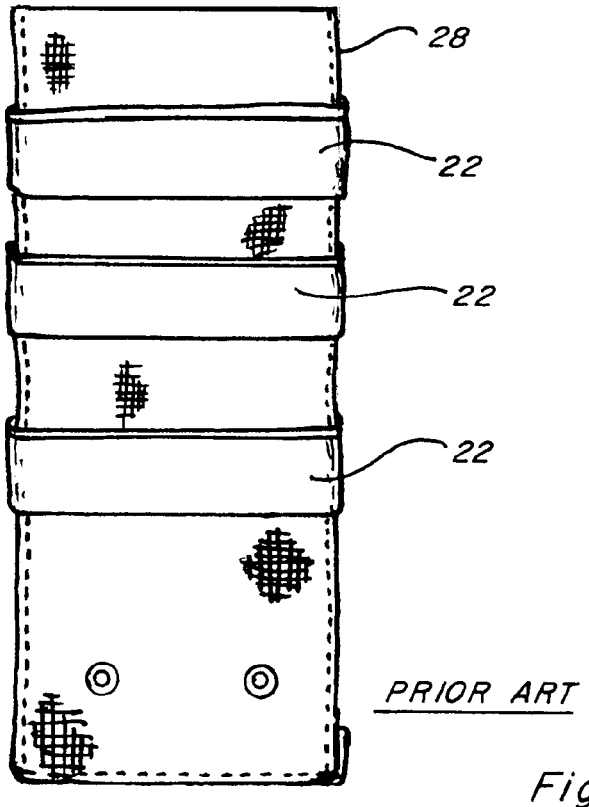
FIG. 4 is a rearview of a standard MOLLE style pouch for use with the system of FIG. 3.

Referring to the drawings, in FIGS. 1, 2 and 4, elements of a conventional prior art MOLLE style attachment system are illustrated. Essentially, the system includes a panel 20 on which straps 22 are sewn or otherwise affixed at longitudinally spaced locations forming a side by side pattern of vertically aligned loops 24. Elongate straps 26 attached to a holder 28, which here is illustrated as a pouch, are interlocked or woven through vertically aligned ones of loops 24 on panel 20, and straps 22 on the back side of holder 28 to attach the holder to panel 20. A fastener, e.g., a snap or button, is often provided on the end of the elongate strap 26 for attachment to an associated fastener on the holder. As discussed above, straps 22 and 26 are relatively heavy, and this weaving and interlocking process is time consuming and requires dexterity. For this and other reasons, an alternative to the widely used MOLLE system is desired.

Referring to FIGS. 3, 5, and 6 through 13, and improved attachment system 32, constructed and operable according to the teachings of the present invention, which can be constructed in a more light weight manner and has other advantages compared to known MOLLE systems, is shown.

Figure 3:
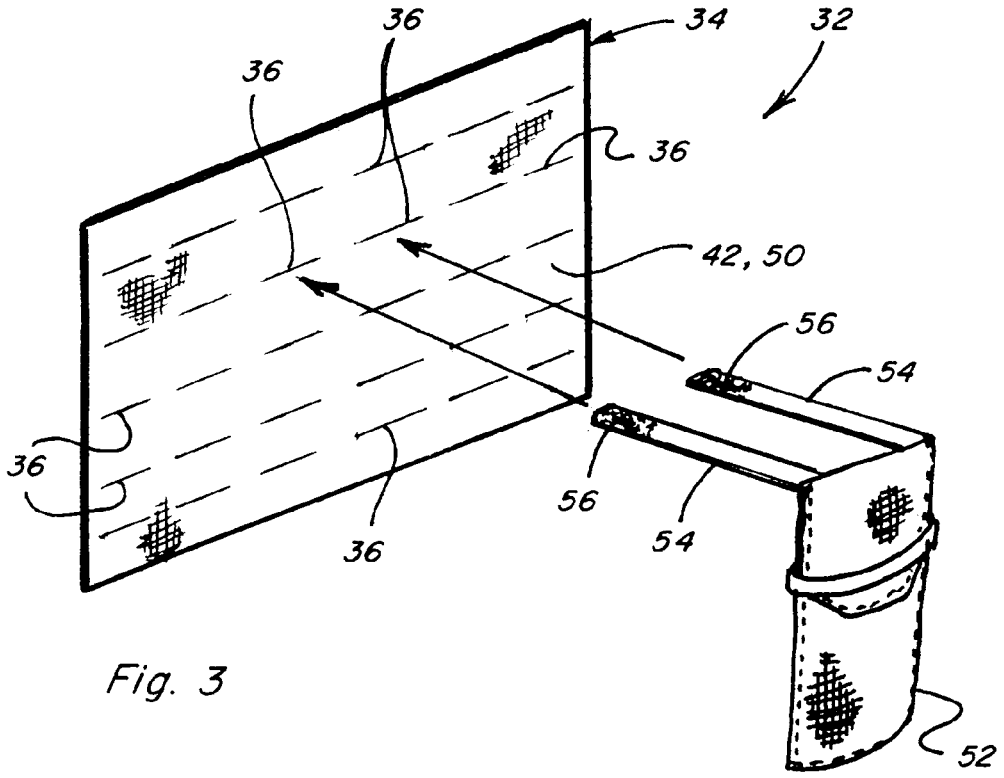
FIG. 3 is an exploded perspective view of one embodiment of an attachment system of the invention showing a representative holder of the system which is a pouch.
Figure 5:
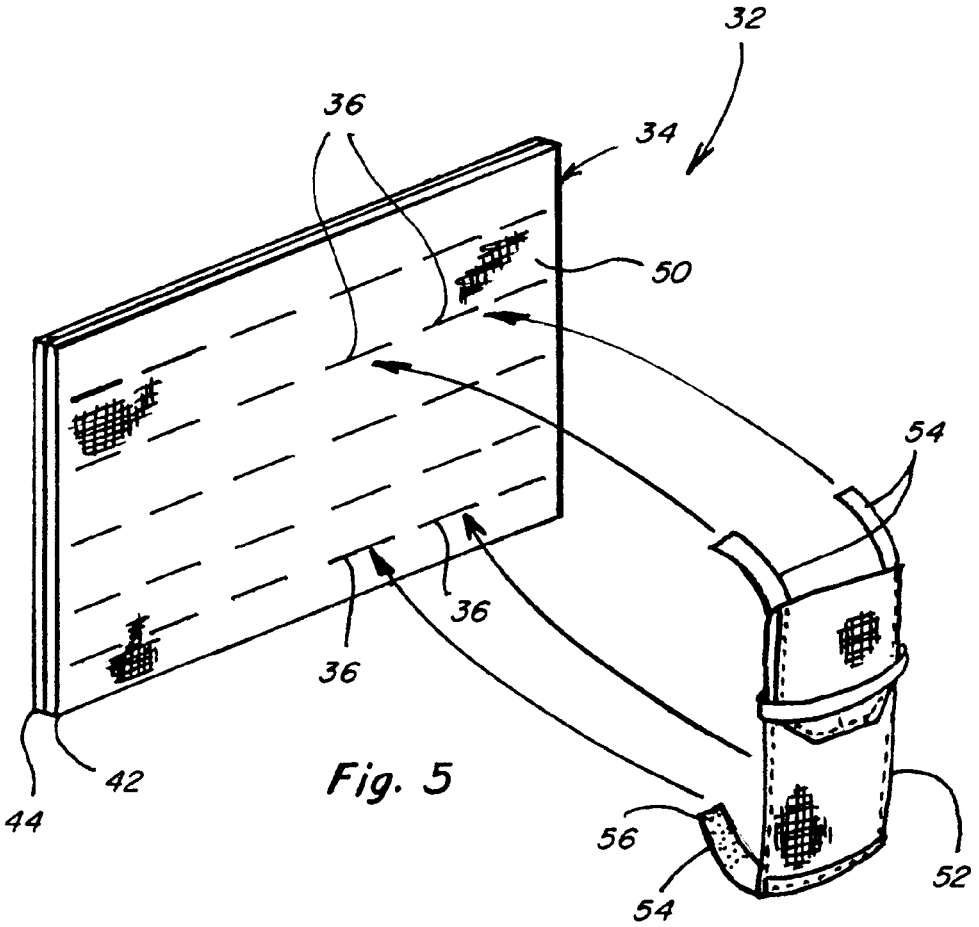
FIG. 5 is an exploded perspective view of another embodiment of an attachment system of the invention, including attachment tabs having hooks of a hook and loop system thereon and a rear fabric of loop pile on a back side of a platform of the system.

Referring to FIGS. 3 and 5, a first embodiment of system 32 of the invention is shown, including a platform 34 which eliminates webbing straps and their associated weight. The platform 34 accomplishes this by comprising a pattern of cuts or slits 36 therethrough arranged in a vertically spaced pattern, at locations generally corresponding to be locations and spacings of the loops of a conventional prior art MOLLE style attachment system as shown in FIGS. 1, 2 and 4. As will be discussed, this provides the advantage of enabling use with various holders, e.g., pouch or accessory, of those prior art systems which are in wide spread use.

Essentially, according to steps of a method of the invention, straps 26 of a MOLLE style holder would be interlocked and woven through the slits 36 of the platform 34 of present system 32, by being inserted through selected upper slits 36 of the platform 34 to the back side of the platform, then inserted through selected lower slits 36 of the platform to the front side thereof, then through webbing straps 22 or loops on the back side of the pouch or accessory. The straps 26 can then be inserted through still lower slits 36 of the platform to the back side, then through still lower slits 36 to the front side, and through webbing loops on the back side of the pouch or accessory, for further attachment, one or more additional times, depending on the length of the straps and platform, and available number of slits. The free end of the straps 26 can them be attached to the back side of the pouch or accessory, using snaps, hook and loop fasteners, or other means provided.

As a preferred aspect of the system of the invention of FIGS. 3 and 5, as illustrated in FIG. 5, the platform 34 can comprise one or more layers of a fabric material, such as, but not limited to, a 500 denier nylon, and/or a sheet or film of other material such as, but not limited to, a plastics film or sheet, e.g., a synthetic rubber compound such as a chloroprene or polychloroprene commercially available from DuPont under the trade name Neoprene, optionally as a laminate, of sufficient overall strength to hold one or more holders such as pouches thereto, while being sufficiently flexible to move with the body of a wearer, such as to accommodate bending and twisting of the torso of the body. For this purpose, at least layer 42 is of a strong material which does not stretch significantly under anticipated loads exerted thereagainst. Other exemplary materials that can be used providing the desired properties can include, but are not limited to, a woven or knitted nylon fabric; woven or knitted loop fabric; woven or knitted polyester fabric; woven or knitted par-aramid synthetic fiber fabric, e.g., such as commercially available under the trade name Kevlar; woven or knitted ultra-high-molecular-weight polyethylene, e.g., such as commercially available under the trade names Dyneema and Spectra; and non-woven para-aramid nylon, a non-woven polyethylene, or other non-woven composition fabric. The lamination can be accomplished in any suitable manner, such as, but not limited to, using a laminating adhesive such as a curable polyurethane applied from water or hot melt. As another alternative, platform 34 can comprise a single composite fabric having a smooth face for the front surface, and a loop pile or hook component of a hook and loop fastening system for the back surface.

The slits 36 can be formed in any manner suitable for the anticipated application, as a non-limiting example, by knife or die cutting, using a button hole machine, or more preferably, by laser cutting. In regard to laser cutting, an advantage achieved is that the edges 38 and 40 (FIG. 7) of the laminated layers bounding and defining the slits 36 can be fused together, to increase stiffness and reduce sagging, reduce or eliminate fraying, and increase wear and abrasion resistance at that location, while still being sufficiently pliable or bendable to facilitate opening and insertion of a strap, or a tab of the invention to be discussed, therethrough. As an additional advantage, edges 38 and 40 can be cut so as to be very closely or intimately spaced, to serve as a barrier to entry or passage of particulate contaminants such as dust and dirt through the slits, to reduce accumulation of the contaminants in an area behind the platform. And, the edges 38 and 40 can be constructed so as to at least generally conform or bias itself about a strap or tab inserted therethrough, so as to maintain the barrier against penetration of particulates when in use.

Additional advantages of the attachment system of the invention include a need for less material, and thus less weight, a reduced side profile, ability to provide a smoother face on the profile of platform 34, and the illustrated ability to use prior art holders such as MOLLE style pouches.

Figure 8:
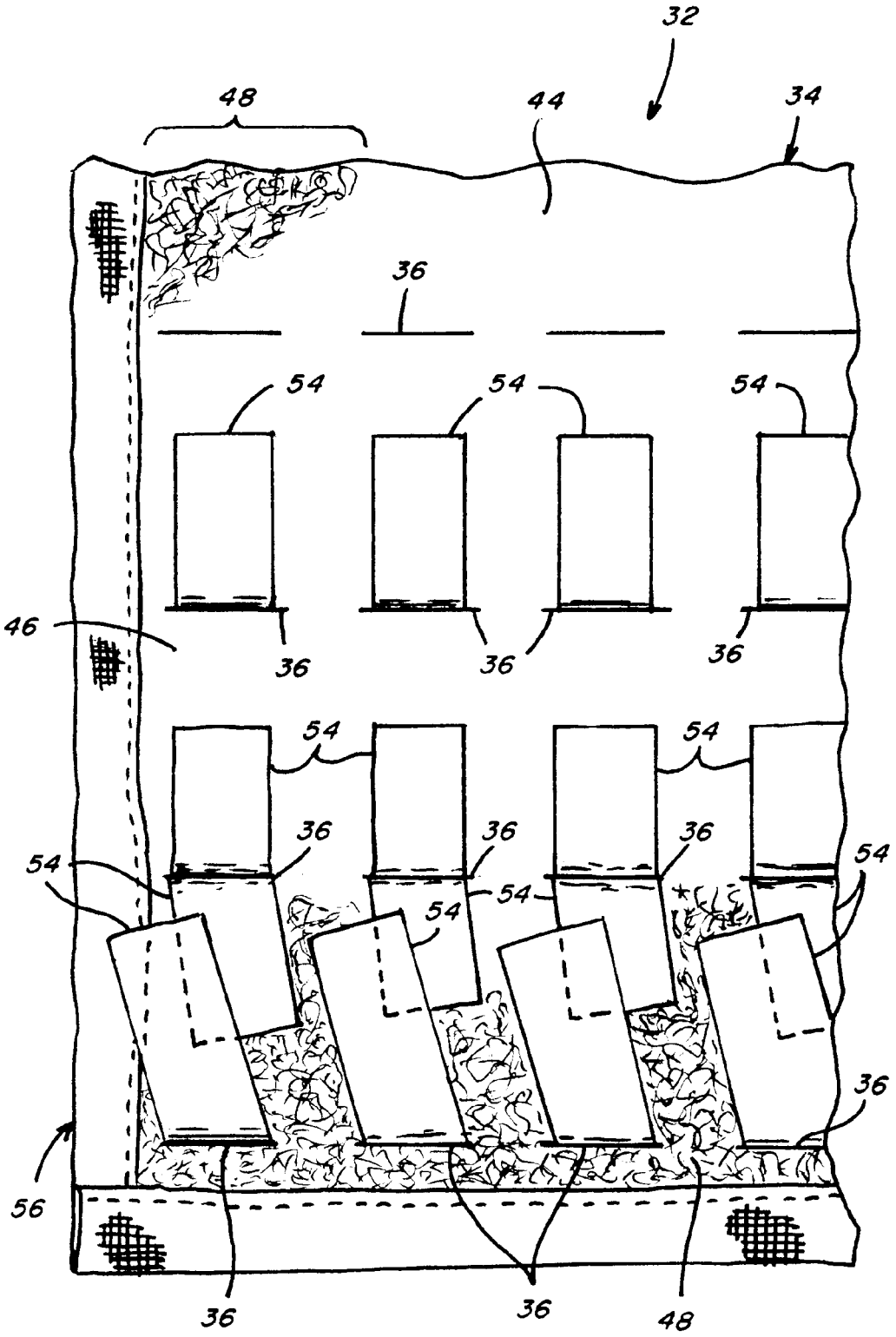
FIG. 8 is another enlargement of the system of FIGS. 6 and 7, showing tabs of pouches inserted through slits of the platform and hooks of the tabs attached to pile on the back side.
Figure 9:
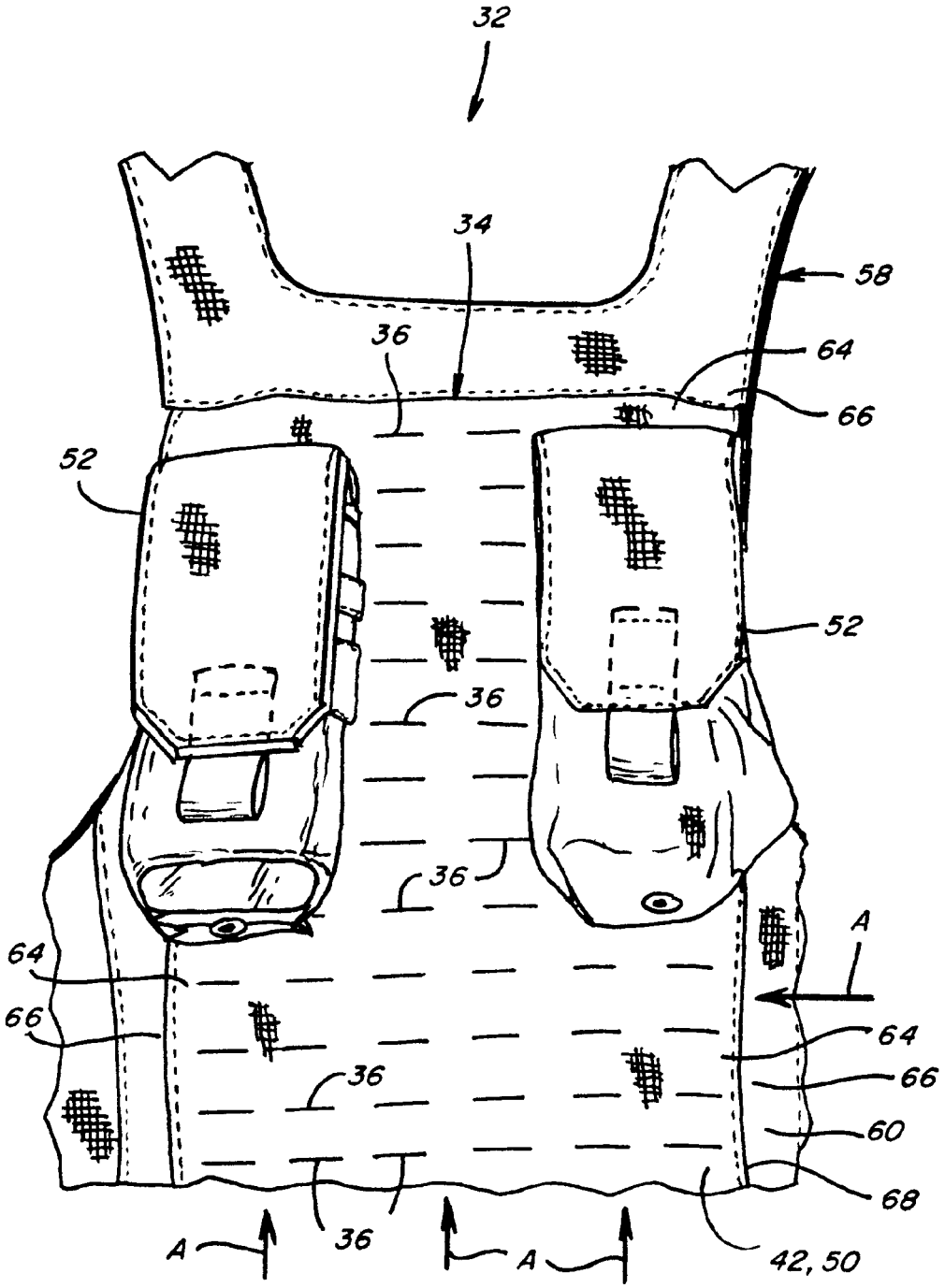
FIG. 9 is fragmentary perspective view of a carrier incorporating the attachment system of the invention, showing two holders attached to the front side of the platform of the system.
Figure 13:
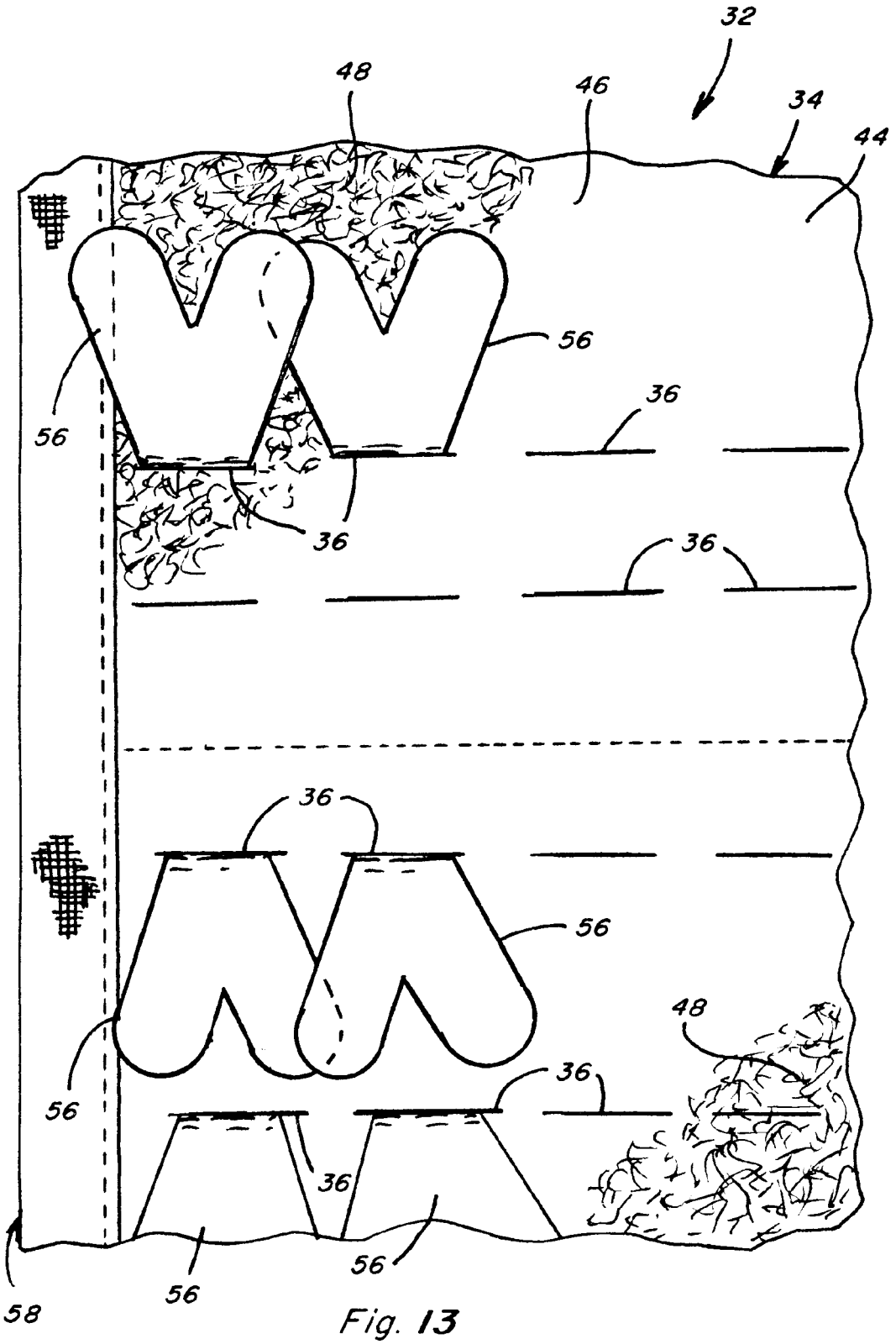
FIG. 13 is a rear view of a platform of the system showing the V shape tabs of FIG. 12 inserted through slits of the platform and having hooks attached to loop pile on the back side of the platform.

Referring more particularly to FIGS. 8 and 13, platform 34 of the attachment system 32 comprises a back side 48 having a first component of a suitable fastening system thereon, such as, but not limited to, a loop pile fabric 48 of a hook and loop fastening system such as available under the trademark Velcro. This can be provided as layer 44 in a layered or laminated, fused, glued, or composite construction with a suitable face fabric layer 42, for example, but not limited to, a 500 denier nylon, on a front side 50 of platform 34. Additionally, one or more intermediate layers can be provided, such as a non-woven layer of a non-stretchable material to provide added strength and shape retention, if desired.

Figure 12:
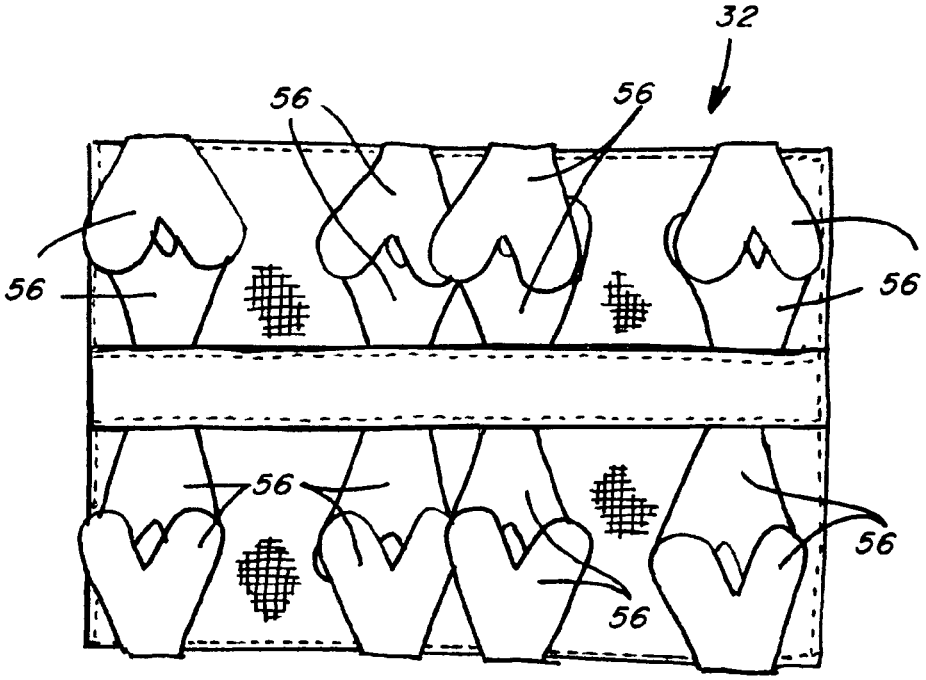
FIG. 12 is a rear view of a holder of the system of the invention, showing alternative V shape tabs.

As another aspect of the invention, the system 32 of the invention can include holders 52, in the form of pouches, appliances and the like, which are also of a light weight construction, to further reduce the weight of the attachment system compared to known MOLLE systems. This will preferably include another component of the fastening system used, here, one or more tabs 54 having hooks 56 of a hook and loop fastening system, releasably attachable to the loop pile fabric 48 on the back side 46 of platform 34. The tabs 54 are configured to be inserted through the slits 36 of the platform and can have any of a variety of shapes, such as, but not limited to, an elongate strap shape (FIGS. 3, 5, 6, 7, 8), or a V shape (FIGS. 12, 13).

Figure 6:
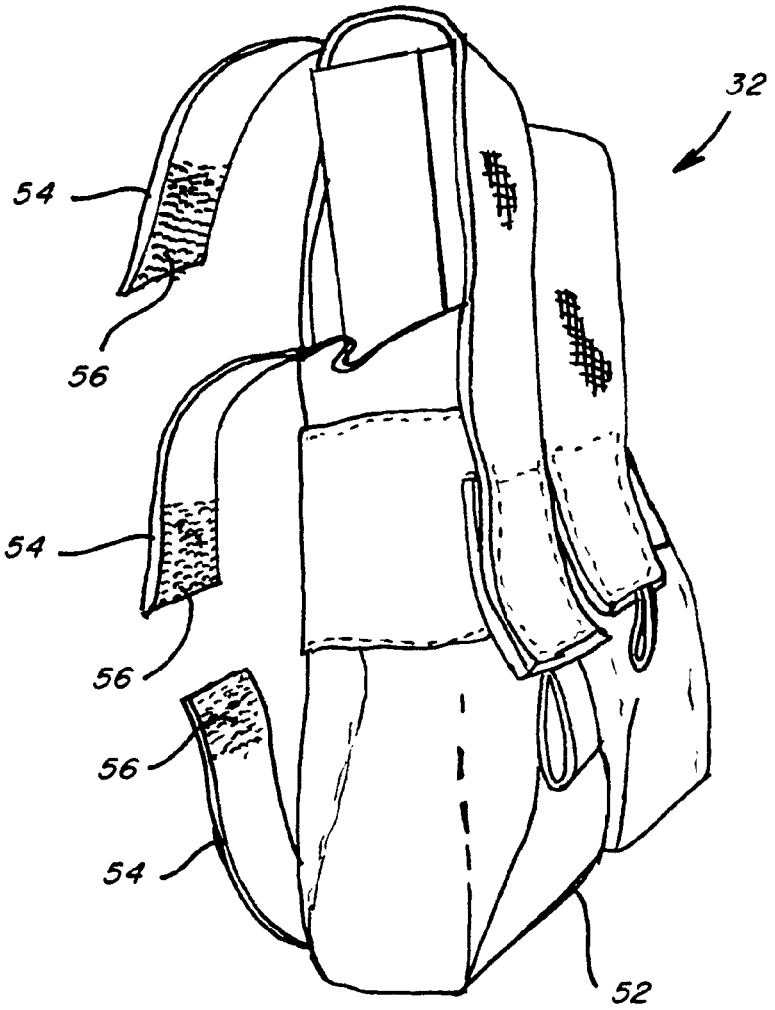
FIG. 6 is an enlarged view of a pouch of the attachment system of FIG. 5 having additional tabs.
Figure 7:
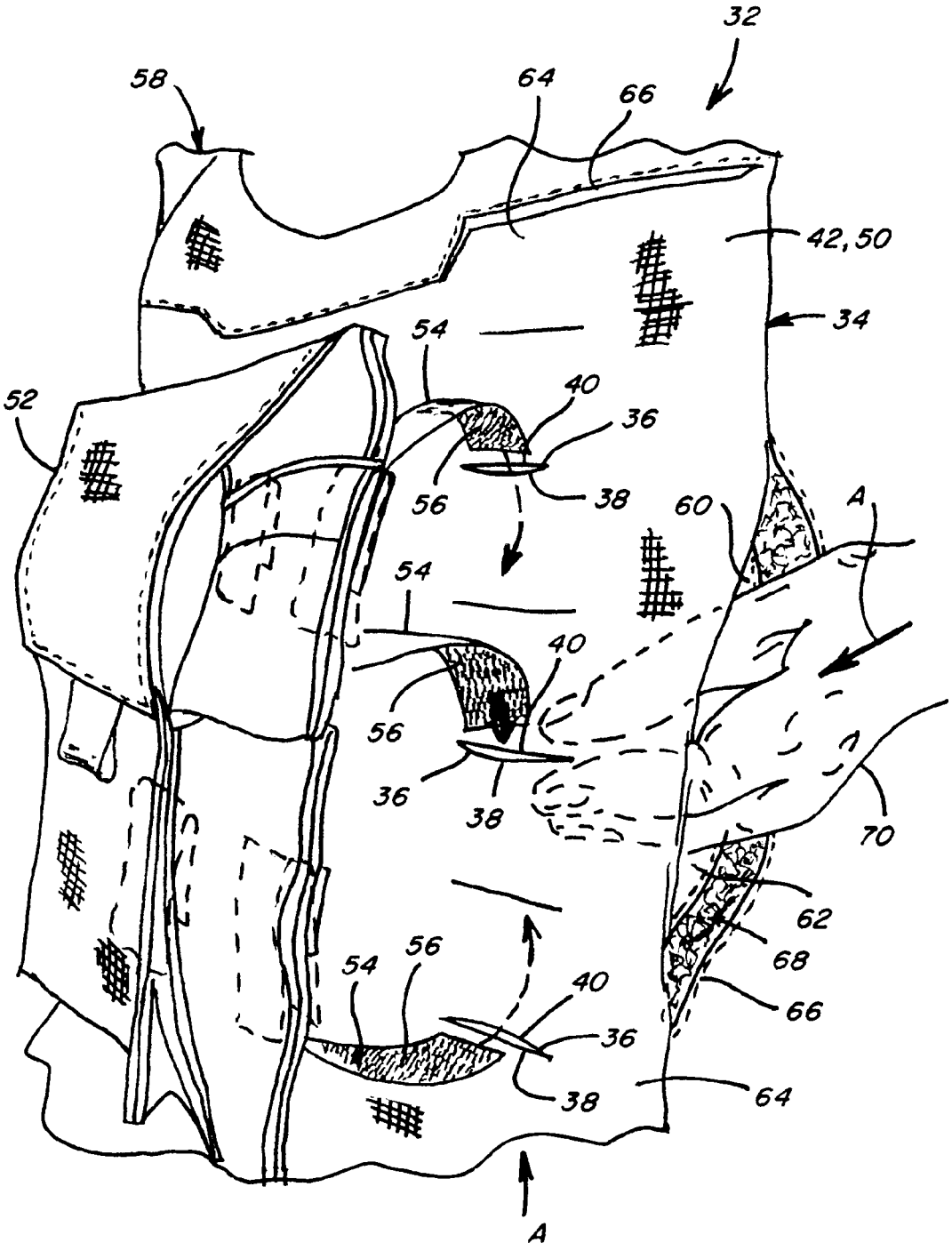
FIG. 7 shows tabs of the pouch of FIG. 6 being inserted through slits of the platform of FIG. 5, shown in place on a representative carrier, and insertion of fingers behind the platform for attaching the tabs to the back side of the platform.

In use, the tabs 54 are inserted into selected slits 36, and the hooks 56 thereof attached to loop pile fabric 48 on the back side 46 of the platform. For strength, when inserted through slits 36, the tabs 54 are bent over for attachment to the back side 46, so that the hook and loop fasteners are loaded in shear, and are not subject to direct pulling away from the back side of the platform. The V shape tabs provide increased holding strength with a shorter overall length and can be folded or bent for insertion through the slits. Tabs 56 can be located at the top, bottom, middle, and/or sides of a holder 52 such as the pouch, appliance or other article to be attached to the platform. As examples, FIG. 3 illustrates tabs 56 on just the top of a holder 52; FIG. 5 illustrates tabs at the top and bottom; and FIGS. 6 and 7 illustrate tabs attached to the top, middle and bottom of a pouch.

FIG. 8 shows the back side 46 of a representative platform 34 of the invention, with top, bottom and middle tabs 54 of a pouch (FIGS. 6 and 7) through respective slits 36 therethrough and attached pile fabric 48. In FIG. 13, V shape tabs have two hook surfaces extending in different direction and attached to the loop fabric.

Figure 10:
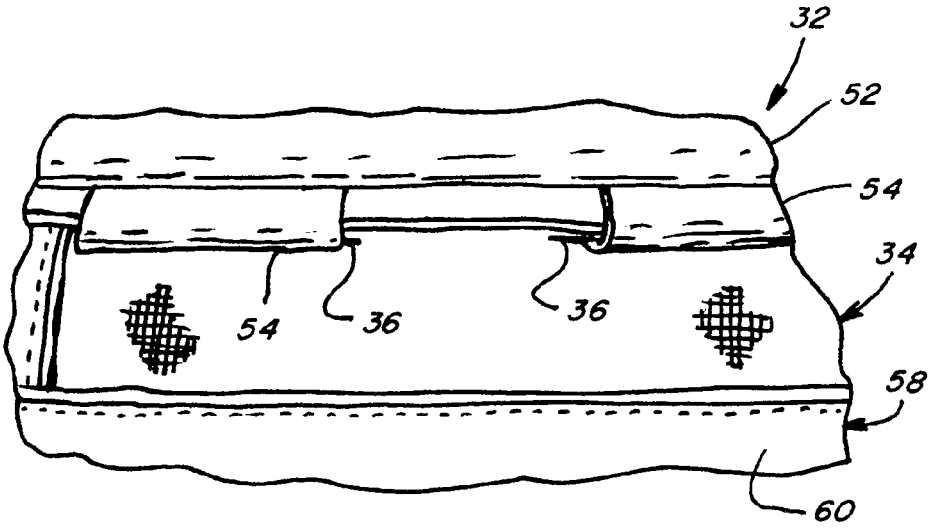
FIG. 10 is fragmentary side view of a representative platform of the system of FIGS. 5 and 6, showing one manner of attachment of tabs, illustrating a tight fit.
Figure 11:
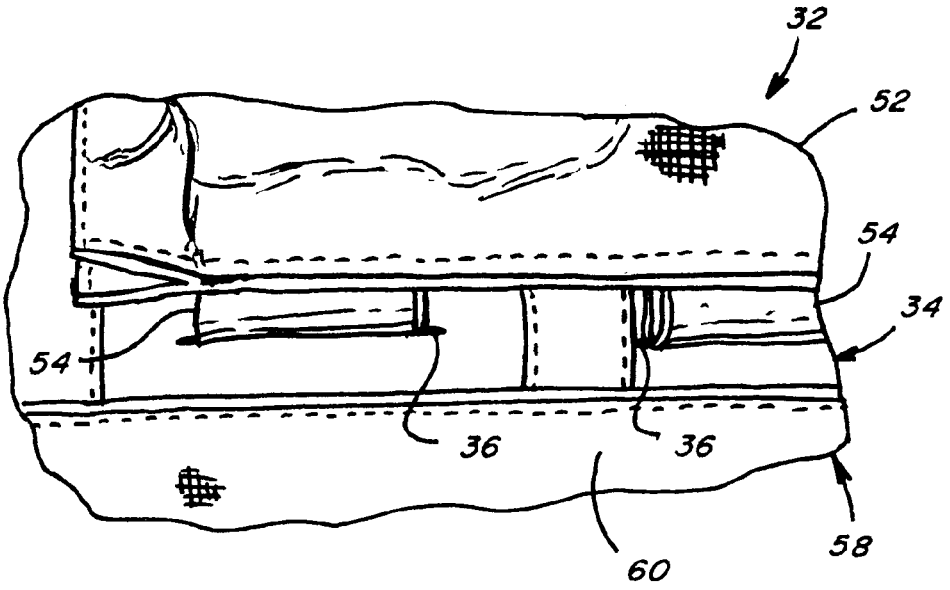
FIG. 11 is fragmentary side view of a representative platform of the system of FIGS. 5 and 6, showing another manner of attachment of tabs, illustrating a loose fit.

As another advantage of the attachment system of the invention, the tightness of attachment of a holder or holders 52 to platform 34 is a function of the location of attachment of tabs 54 to back side 46. As illustrated in FIG. 10, tabs 54 can be attached to the back side of the platform tightly with little slack, in a manner so as to limit or prevent relative movements of the holder relative to the platform, which may be desirable for some applications, e.g., wherein low noise is desired or required. In FIG. 11, tabs 54 are illustrated attached to the back side of the platform more loosely with greater slack, to allow movement of the holder on the front side, which may increase comfort and freedom of movement for the user.

Figure 14:
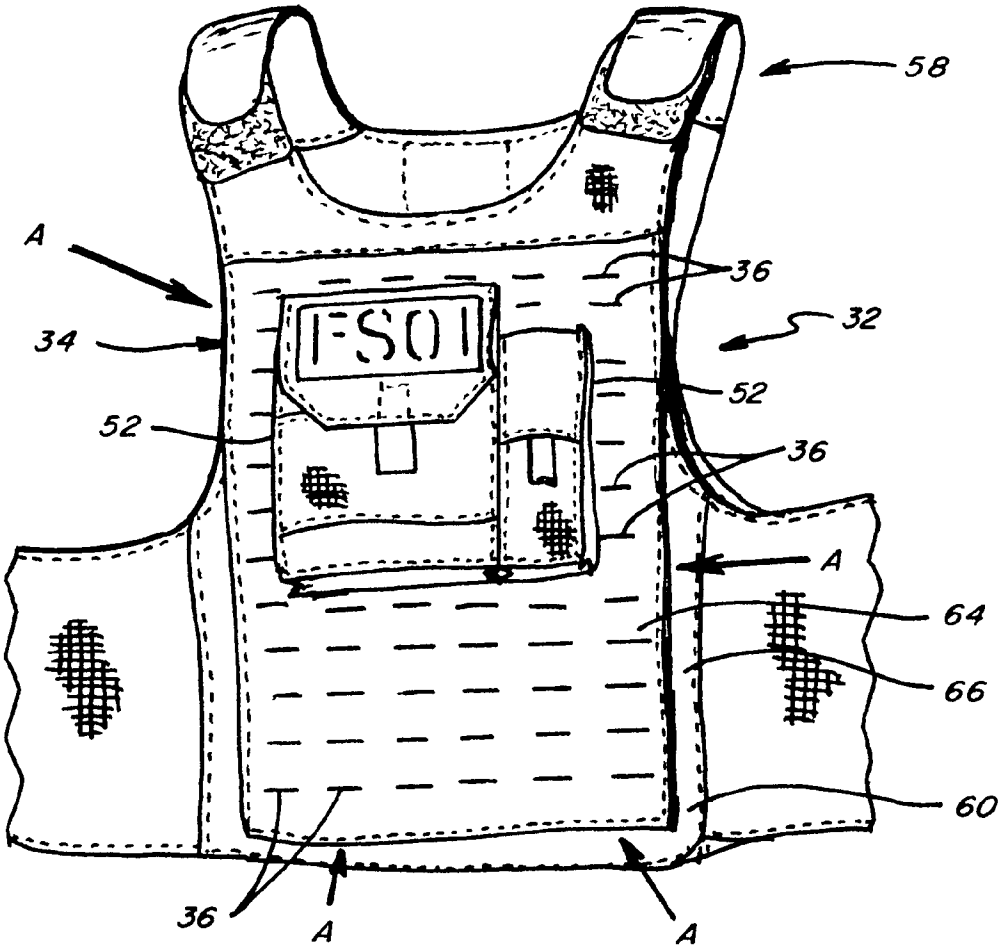
FIG. 14 is a front view of a platform of the system of the invention on a representative carrier, showing representative holders attached thereto by passage of tabs on the backs of the holders through slits of the platform of the system.

Referring also to FIG. 14, in use on a carrier 58 to be worn on a part of a persons body, which carrier can comprise, but is not limited to, a vest, cummerbund, backpack, shirt, pants, belt, etc., platform 34 is preferably attached, connected, or incorporated into the carrier in a manner such that the platform 34, holder or holders 52, and items carried in the holders, e.g., ammunition magazines, batteries, radios, medical supplies, tools, etc., are supported in the desired manner on the wearing person's body. This can be accomplished by attaching, e.g., fastening or sewing, one or several peripheral edges of platform 34 to carrier 58 such that platform 34 overlays or covers all or a portion of an outer surface 60 of the carrier. As a result, back side 46 of platform 34 faces and covers all or a portion of surface 60, forming and enclosing a cavity or pocket 62 therebetween. Platform 34 has a peripheral edge 64 thereabout that overlays a peripheral edge 66 of outer surface 60, and which is attached to surface about the periphery of the platform, but at least one open edge portion or openable closure 68 (FIGS. 7 and 9) is preferably provided to allow a person to insert at least the fingers of a hand 70 through the closure when open, as denoted by arrow A and into pocket 62 for accessing tabs 54 or straps inserted through slits 36, for attaching and detaching the hook and loop fasteners. Closure 68 can comprise for example, but is not limited to, a hook component of a hook and loop fastening system attachable to the loop pile fabric of back side 46, snaps, a zipper, overlapping flaps, tied or laced strings or cords, a draw cord, or the like. The opening or openable closure 68 can be located along any suitable edge of the platform as denoted by arrow A in various of the FIGS., which provides sufficient attachment strength for supporting desired holders and carried items, while serving also as a barrier to entry of particulates into pocket 62. Location of the components of the attachment system 32 within pocket 62 also provides a cover for muffling or silencing sounds generated when detaching the tabs. And, the attachment in this manner is advantageous as it can be performed easily by feel.

Figure 15:
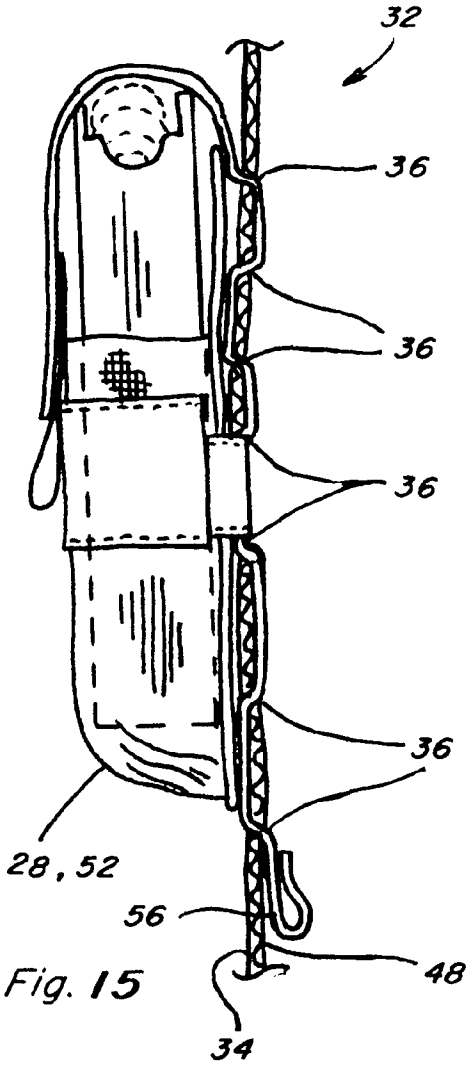
FIG. 15 is a side view of a platform of the system, showing a pouch having longer tabs such as illustrated in FIG. 3, woven through the slits and attached to the platform by the hook and loop fasteners on the end of the tabs.
Figure 16:
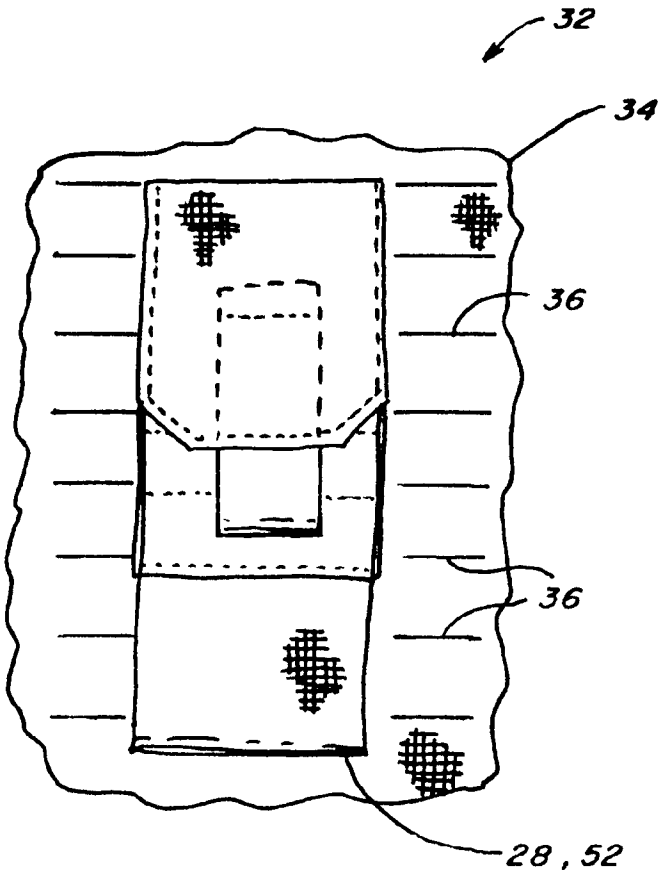
FIG. 16 is a front view of the platform and pouch of FIG. 15.
Figure 17:
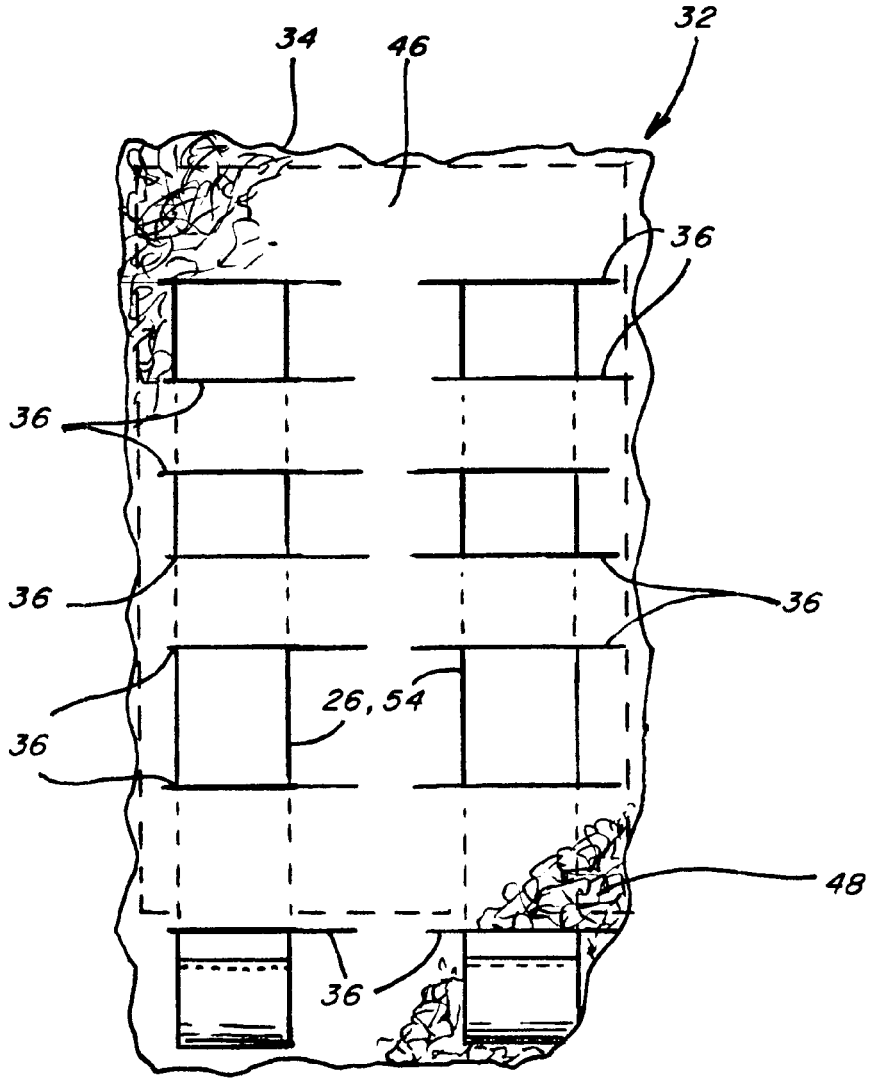
FIG. 17 is a rear view of the platform and tabs of FIG. 15, weaving and attachment of the tabs.

As noted above, an advantage of the system of the invention is backward compatibility with existing MOLLE and similar systems to enable use of MOLLE style holders 28 having long straps 26, and also holders 52 of the present system having longer tabs 54 with hooks 56 at the ends such as shown in FIG. 3. This is illustrated in FIGS. 15, 16 and 17, where straps 26 or long tabs 54 are woven through slits 36 through platform 34 and interlocked with straps (if provided) on the back of holder 28. If tabs 54 are used, the hooks 56 on the ends are then attached to the pile fabric 48 on the back side 46 of the platform.

Figure 18:
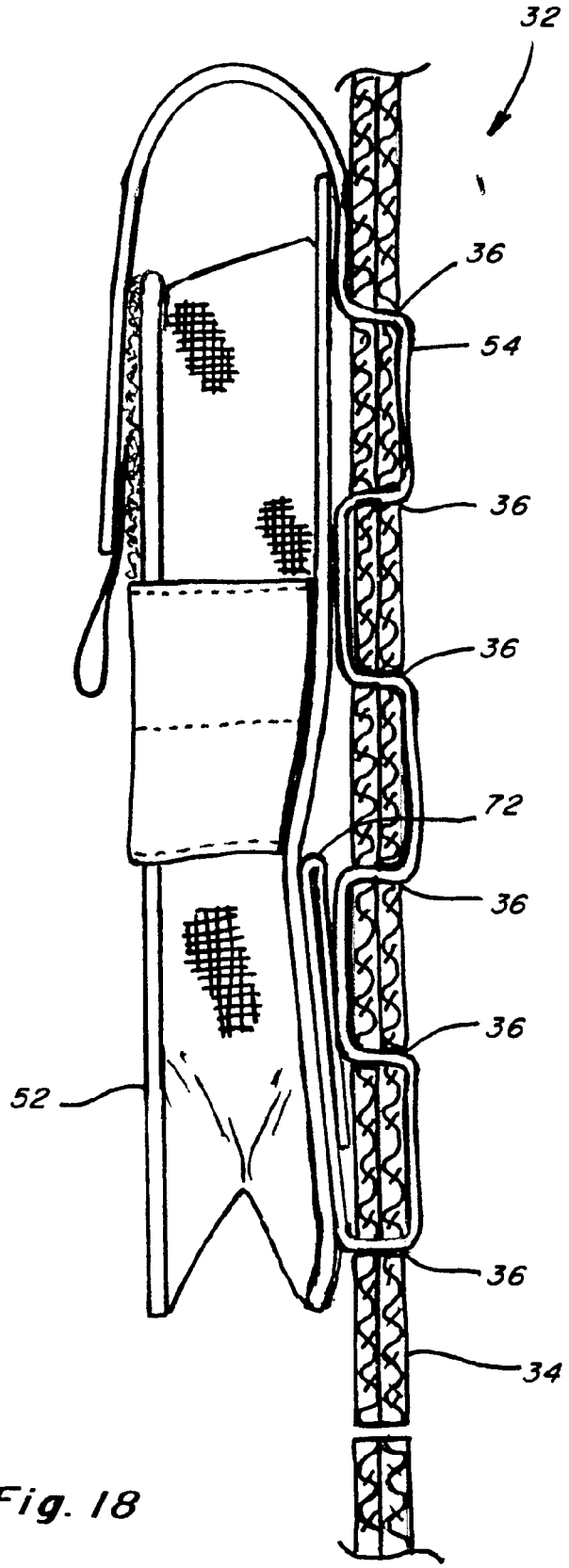
FIG. 18 is a side view of a platform of the system of the invention, showing attachment of an alternative holder having an elongate tab with a tuck tab on the end.

Referring also to FIG. 18, as another variant, a holder 52 having longer tabs 54 with a semi-rigid tuck tab 72 on the end can be woven through slits 36 through platform 34 of system 32, and the tuck tab tucked between the back side of the holder and the front side of the platform, or into an aperture in the back of the holder or a slit for supporting the holder on the front side of the platform. In this regard, it should be noted and understood that as an option, any holder for use with the system can include slits through the back side thereof for weaving of straps or the longer tabs therethrough for attachment as an alternative to using multiple tabs at spaced locations along the length of the holder. Further in this regard, it is contemplated that the tuck tabs 72 will have a length appropriate for self-retention between the holder and platform, or receipt in an aperture or slit on the back of the holder or on the platform. As a representative example, a tuck tab 72 can have a length equal to at least about the vertical distance between two or three slits 36, or 1 to 2 inches.

Figure 19:
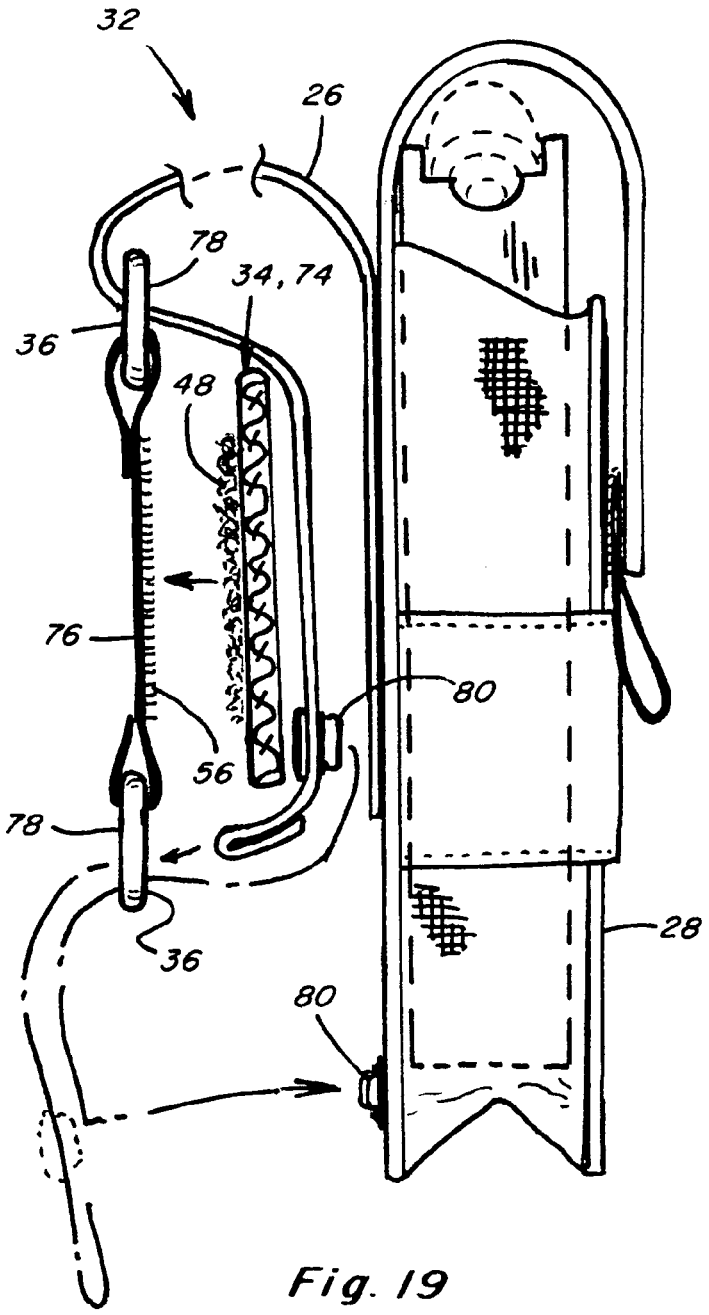
FIG. 19 is a side assembly view of an alternative embodiment of the invention having slits on a removable backing element attachable to a platform of the invention, and weaving of a conventional MOLLE style strap through the slits for attachment of a pouch to the platform.

Referring also to FIG. 19, as another embodiment of the system 32 of the invention, particularly having utility for attachment of longer MOLLE style holders 28 such as magazine pouches to shorter platforms 34, such as can be incorporated into or used as a belt 74, platform 34, e.g., in the form of a belt 74 includes the first component of the hook and loop fastening system, e.g., loop pile fabric 48, on its back side, and the second component, e.g., loops 56, is provided on a separate backing element 76 including slits 36 at upper and lower ends thereof, for instance, extending through flat rings 78 attached, e.g., by sewing. Backing element 76 can be of suitable material such as a non-stretchable fabric, plastics, or metal, and rings 78 can be fabric, plastics, or metal also. In use, backing element 76 will be attached to the back side of platform 34 via the hook and loop fasteners, and strap 26 inserted through slits 36 of rings 78, so as to pass between the back side of the holder 28 and front side of platform 34. A snap or other component of a fastener 80 on the end of the strap can then be fastened to its associated component on the holder 28 to secure the holder to the platform. Here, it should be noted that the size of slits 36 will be advantageously provided to be just marginally larger or smaller in thickness compared to the strap 26 so that frictional forces exist therebetween, such that holder 28 will be held in a fixed position on the platform (belt).

Here, it can be observed that relatively long pouches can be provided with shorter tabs of the invention, for easy attachment and removal, without requiring complex weaving of long straps through loops on both the platform and the pouch itself. The tabs are merely inserted through the selected slots, folded or bent over from the side or another direction, and attached to the back side of the platform, which is made easy due to the relatively short length of tabs that can be used with good holding strength. The system of the invention also requires less material, is of less weight, and has a reduced profile when viewed from the side. This allows the face of the platform to be smoother.

In light of all the foregoing, it should thus be apparent to those skilled in the art that there has been shown and described a novel modular pouch attachment system for carriers such as vests, belts, and the like. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. An attachment system, comprising:

a platform having a front side, an opposite back side, the platform comprising at least two woven nylon fabric layers laminated together by an adhesive layer therebetween, the platform having a plurality of slits therethrough defined and bound by edges of the layers fused together to have increased stiffness, wear and abrasion resistance, the slits arranged in a predetermined pattern of aligned and spaced apart rows, the slits being configured to receive straps therethrough between the front side and the back side to attach at least one holder to the front side, and the platform being supported by and comprising an element of a carrier configured to be worn against a portion of a user's body, the back side and at least one element of the carrier or a backing element having coextensive edges bounding a generally flat cavity through which the back side can be accessed.

2. The attachment system of claim 1, wherein at least one of the woven nylon fabric layers comprises a 500 denier nylon fabric.

3. The attachment system of claim 1, wherein each of the at least two woven nylon fabric layers comprises a 500 denier nylon fabric.

4. The attachment system of claim 1, wherein at least one of the woven nylon fabric layers comprises a layer of a synthetic rubber compound.

5. The attachment system of claim 1, wherein at least one of the fabric layers comprises par-aramid synthetic fibers.

6. The attachment system of claim 1, wherein the edges are laser fusion hardened.

7. The attachment system of claim 1, further comprising at least one strap woven through selected ones of the slits attaching a holder to the front side of the platform.

8. The attachment system of claim 1, wherein the coextensive edges of the back side and the at least one element of the carrier or the backing element along at least one edge of the platform, comprise components of a fastening system configured to be fastened together to prevent entry of particulates therebetween, and unfastened to allow manually accessing the back side of the platform therebetween.

9. The attachment system of claim 8, wherein the fastening system comprises a hook and loop fastening system.

10. The attachment system of claim 1, wherein the carrier comprises a vest, a cummerbund, or a belt.

11. The attachment system of claim 1, wherein the edges that bound and define the slits are intimately spaced to serve as a barrier to entry of particulates through the slits.

12. The attachment system of claim 1, wherein the predetermined pattern of aligned and spaced apart rows comprises a plurality of the slits disposed in multiple side by side, spaced apart upwardly and downwardly extending rows, and the slits of each of the upwardly and downwardly extending rows extending sidewardly.

13. An attachment system for removably attaching at least one holder to a carrier configured for wear on a human body, the carrier having at least one outer surface oriented to face away from a body on which the carrier is worn, the attachment system comprising:

a platform supported in an upstanding orientation on the carrier in covering relation to a surface of the carrier or an opposing backing element to bound and enclose a generally flat cavity therebetween, the platform having a front side facing outwardly, an opposite back side facing the cavity, the platform comprising a composite fabric having a smooth surface as the front side, and a first fastening component of a hook and loop fastening system as the back side, and a plurality of slits defined and bound by opposing hardened fused edges of the composite fabric, the slits arranged in a predetermined pattern of aligned and spaced apart rows.

14. The attachment system of claim 13, further comprising at least one holder configured for holding an article or object, having at least one flat, flexible tab or strap extending therefrom and extending through at least one of the slits and attached to the platform or the holder to releasably secure the holder adjacent to the front side of the platform.

15. The attachment system of claim 14, wherein the at least one flat, flexible tab or strap comprises a tab having a second fastening component of the hook and loop fastening system fastenable to the first fastening component of the hook and loop fastening system as the back side of the platform.

16. The attachment system of claim 15, wherein the holder comprises a plurality of the tabs having the second fastening component, extending through a plurality of the slits, respectively, and releasably fastened to the first fastening component of the system as the back side of the platform.

17. The attachment system of claim 14, wherein the at least one flat, flexible tab or strap comprises a strap having one end attached to the holder and woven through at least two of the slits, and a second end releasably fastened to the holder.

18. The attachment system of claim 14, wherein the opposing hardened fused edges are intimately spaced to serve as a barrier to entry of particulates through the slits.

19. An attachment system for supporting holders on a carrier, including a platform comprising a front side and laminated layers having a plurality of slits therethrough arranged in a predetermined pattern of aligned and spaced apart rows; and the platform having a back side opposite the front side and opposing a surface of the carrier or a backing element to enclose a generally flat pocket therebetween generally coextensive with the platform, the slits extending through the platform to the pocket and being defined and bounded by fused edges of the laminated layers that stiffen the platform and prevent sagging, and the slits being configured for receiving one or more elongate straps or tabs to support a holder adjacent to the front side.

20. The attachment system of claim 19, wherein the fused edges of the laminated layers are intimately spaced to serve as a barrier to entry of particulates through the slits.

21. The attachment system of claim 19, further characterized by a holder supported adjacent to the front side of the platform by at least one substantially flat, flexible strap woven through at least two of the aligned slits.

22. The attachment system of claim 19, wherein the laminated layers comprise an adhesive layer between a layer comprising the front side and a layer comprising the back side.

23. The attachment system of claim 19, wherein at least one of the layers comprises par-aramid synthetic fiber fabric.

* * * * *